US009323203B2

(12) United States Patent
Kawashima

(10) Patent No.: US 9,323,203 B2
(45) Date of Patent: Apr. 26, 2016

(54) SHEET TRAY, SHEET FEEDER WITH SHEET TRAY,IMAGE FORMING APPARATUS WITH SHEET TRAY, AND IMAGE READING DEVICE WITH SHEET TRAY

(71) Applicant: KYOCERA Document Solutions Inc., Osaka (JP)

(72) Inventor: Tetsuro Kawashima, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/183,324

(22) Filed: Feb. 18, 2014

(65) Prior Publication Data

US 2014/0241775 A1 Aug. 28, 2014

(30) Foreign Application Priority Data

Feb. 22, 2013 (JP) ..... 2013-033308

(51) Int. Cl.

| | |
|---|---|
| ***B65H 1/00*** | (2006.01) |
| ***B65H 1/26*** | (2006.01) |
| ***G03G 15/00*** | (2006.01) |
| ***B65H 1/04*** | (2006.01) |

(52) U.S. Cl.

CPC ..... *G03G 15/6514* (2013.01); *B65H 1/04* (2013.01); *B65H 1/266* (2013.01); *G03G 15/605* (2013.01); *B65H 2405/1122* (2013.01); *B65H 2405/1124* (2013.01); *B65H 2405/324* (2013.01); *B65H 2407/21* (2013.01)

(58) Field of Classification Search

CPC . G03G 15/6514; G03G 15/605; G03G 15/00; G03G 21/00; B65H 1/26; B65H 1/00; B65H 2405/1113; B65H 2405/1115; B65H 2407/21

USPC ..... 399/392; 271/9.09

See application file for complete search history.

(56) References Cited

U.S. PATENT DOCUMENTS

| | | | | |
|---|---|---|---|---|
| 6,056,286 | A * | 5/2000 | Koga | 271/145 |
| 7,036,813 | B2 * | 5/2006 | Asada | B65H 3/0669 271/117 |

(Continued)

FOREIGN PATENT DOCUMENTS

| | | | | |
|---|---|---|---|---|
| CN | 101920858 | A | 12/2010 | |
| EP | 0535648 | A2 * | 4/1993 | G03G 15/60 |

(Continued)

OTHER PUBLICATIONS

Notice of Rejection mailed by Japan Patent Office on Apr. 14, 2015 in the corresponding Japanese patent application No. 2013-033308—2 pages.

(Continued)

*Primary Examiner* — Nguyen Ha

(74) *Attorney, Agent, or Firm* — Knobbe, Martens, Olson & Bear LLP

(57) ABSTRACT

A sheet tray includes a tray section. A rear end portion of the tray section capable of supporting an upstream side of a sheet in a direction of conveyance of the sheet extends in a width direction of the sheet transversely of the direction of conveyance of the sheet. Both ends of the rear end portion of the tray section in the width direction of the sheet are raised upward perpendicularly to a placement surface relative to the middle of the rear end portion in the width direction of the sheet.

6 Claims, 12 Drawing Sheets

(56) References Cited

U.S. PATENT DOCUMENTS

| | | | | |
|---|---|---|---|---|
| 7,708,263 | B2 * | 5/2010 | Yano et al. | 271/9.09 |
| 7,963,517 | B2 * | 6/2011 | Shiohara | B41J 11/485 271/9.01 |
| 8,690,147 | B2 * | 4/2014 | Okuchi | 271/162 |
| 2004/0021901 | A1 * | 2/2004 | Watanabe | H04N 1/00278 358/1.15 |
| 2005/0141936 | A1 * | 6/2005 | Kawashima | 399/392 |
| 2006/0071399 | A1 * | 4/2006 | Asada | B65H 3/0684 271/117 |
| 2006/0182485 | A1 * | 8/2006 | Ogawa | B41J 13/103 400/647 |
| 2007/0222136 | A1 * | 9/2007 | Murakami | B65H 1/04 271/9.09 |
| 2009/0267283 | A1 * | 10/2009 | Mizuguchi | B65H 1/04 271/3.14 |
| 2010/0314821 | A1 | 12/2010 | Ohno | |
| 2011/0001284 | A1 * | 1/2011 | Ohtsuki | B65H 5/26 271/162 |

FOREIGN PATENT DOCUMENTS

| | | | | |
|---|---|---|---|---|
| EP | 0939045 | A2 * | 9/1999 | B65H 31/02 |
| EP | 0942582 | A1 * | 9/1999 | B65H 1/00 |
| JP | 2002-167083 | A | 6/2002 | |
| JP | 2004250207 | A * | 9/2004 | B65H 11/00 |
| JP | 2007-137680 | A | 6/2007 | |
| JP | 2007217124 | A * | 8/2007 | B65H 1/04 |
| JP | 2009-096598 | A | 5/2009 | |
| JP | 2009292602 | A * | 12/2009 | G03G 15/00 |

OTHER PUBLICATIONS

Notice of First Office Action from SIPO dated Nov. 2, 2015 in the corresponding Chinese patent application No. 201410056950.6—7 pages.

* cited by examiner

SHEET TRAY, SHEET FEEDER WITH SHEET TRAY,IMAGE FORMING APPARATUS WITH SHEET TRAY, AND IMAGE READING DEVICE WITH SHEET TRAY

INCORPORATION BY REFERENCE

This application claims priority to Japanese Patent Application No. 2013-33308 filed on Feb. 22, 2013, the entire contents of which are incorporated by reference herein.

BACKGROUND

The present disclosure relates to a sheet tray on which a sheet is to be placed, a sheet feeder with the sheet tray, an image forming apparatus with the sheet tray, and an image reading device with the sheet tray.

As a sheet tray on which a sheet is to be placed, a manual feed tray is disclosed which is pivotally mounted, with its lower end as a pivot axis, to an apparatus body of an image forming apparatus to allow it to be opened out by the pivotal movement. When the manual feed tray is opened from outside the apparatus body, it becomes possible to place a sheet on the manual feed tray. The sheet is introduced to the inside of the apparatus body and an image is then formed on the sheet.

SUMMARY

A technique further modified from the above known technique is proposed as one aspect of the present disclosure.

A sheet tray according to an aspect of the present disclosure includes a tray section including a placement surface on which a sheet is to be placed.

A rear end portion of the tray section capable of supporting an upstream side of the sheet in a direction of conveyance of the sheet extends in a width direction of the sheet transversely of the direction of conveyance of the sheet.

Furthermore, both ends of the rear end portion in the width direction of the sheet are raised perpendicularly to the placement surface relative to the middle of the rear end portion in the width direction of the sheet.

A sheet feeder according to another aspect of the present disclosure includes the aforementioned sheet tray, a sheet conveyance path, and a conveyance section.

The sheet conveyance path leads out of the forward end portion of the tray section.

The conveyance section is configured to convey the sheet placed on the tray section to the sheet conveyance path.

An image reading device according to still another aspect of the present disclosure includes a device body, the sheet feeder, and a reading section.

The sheet feeder is disposed in the device body and provided to convey a sheet serving as an original document.

The reading section is disposed facing the sheet conveyance path and configured to read an image of the original document.

An image forming apparatus according to still another aspect of the present disclosure includes an apparatus body, an image forming section, and the aforementioned sheet feeder.

The image forming section is disposed in the apparatus body and configured to form an image on a sheet.

The sheet feeder is provided to convey the sheet toward the image forming section.

The sheet tray of the sheet feeder is a manual feed tray mounted to the apparatus body.

DETAILED DESCRIPTION

Figure 1:
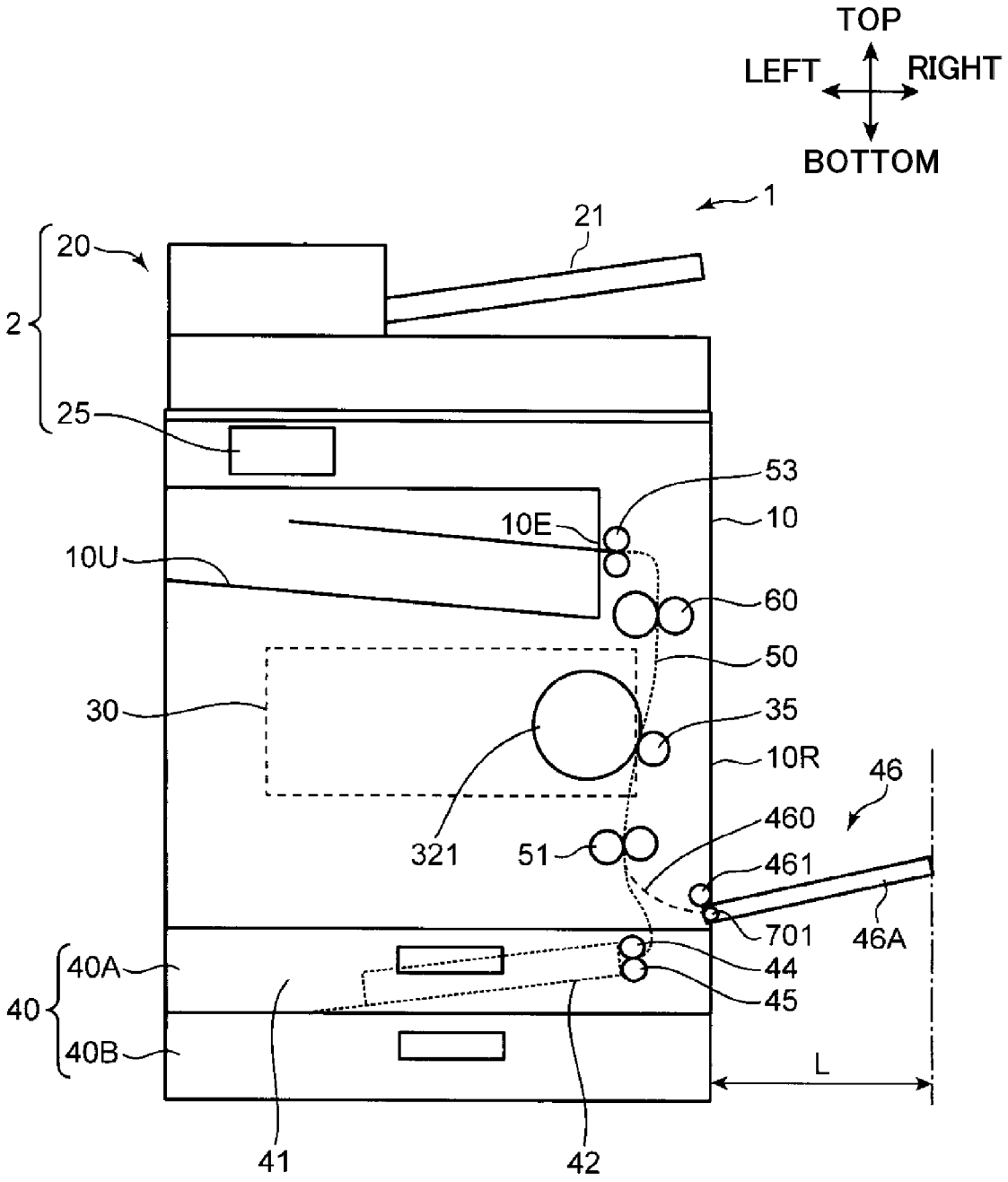
FIG. 1 is a schematic cross-sectional view showing the structure of an image forming apparatus according to an embodiment of the present disclosure.
Figure 2:
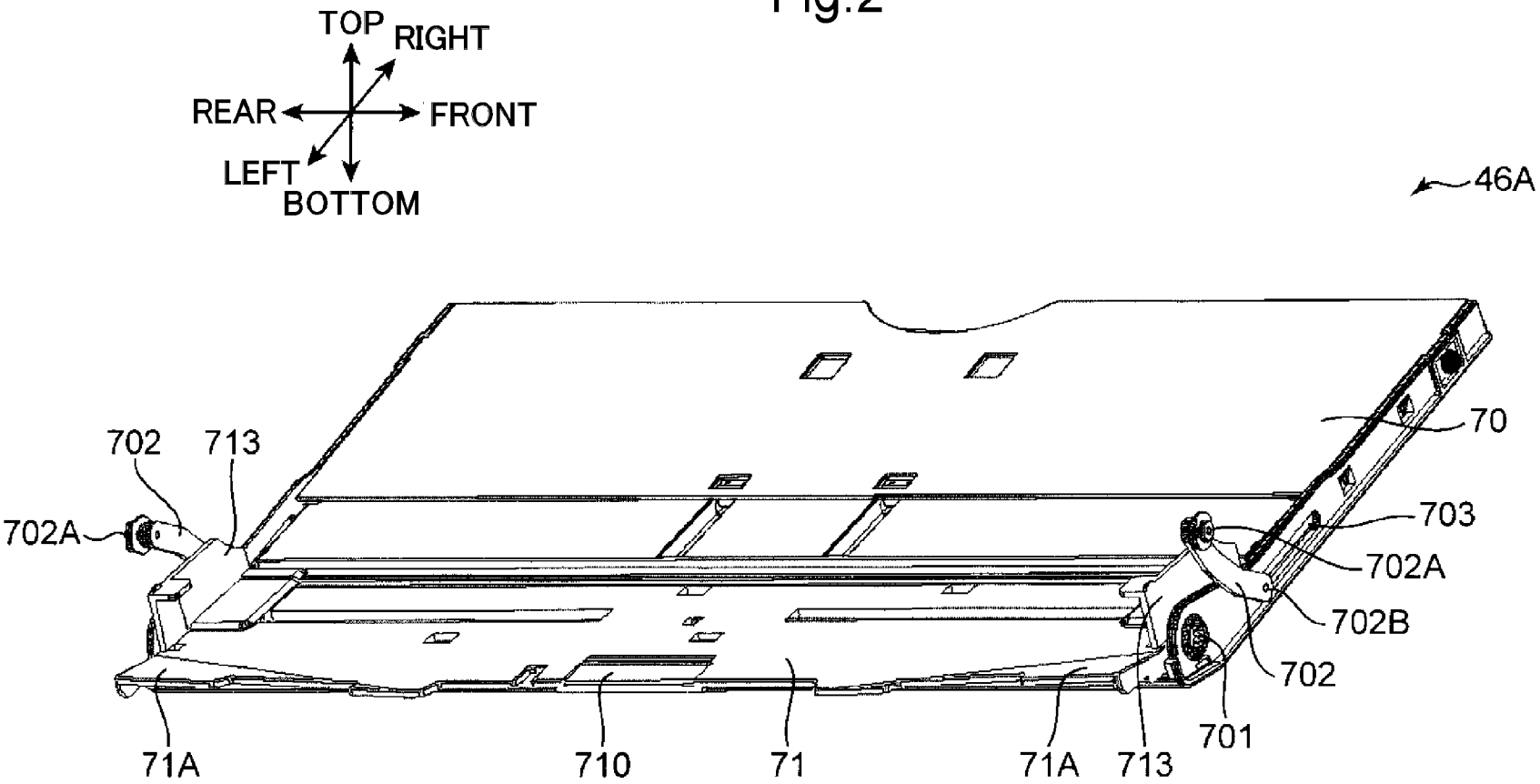
FIG. 2 is a perspective view of a manual feed tray according to the embodiment of the present disclosure.

Hereinafter, a detailed description will be given of an embodiment of the present disclosure with reference to the drawings. FIG. 1 is a schematic cross-sectional view showing the internal structure of an image forming apparatus 1 according to an embodiment of the present disclosure. Here, a multifunction peripheral having a printer function and a copy function is exemplified as the image forming apparatus 1. However, the image forming apparatus may be a printer, a copier or a facsimile machine.

<Description of Image Forming Apparatus>

The image forming apparatus 1 includes an apparatus body 10 having an approximately cuboid housing structure and an automatic document feeder (ADF) 20 disposed on top of the apparatus body 10. The apparatus body 10 houses: a reading unit 25 (reading section) configured to optically read an image of an original document to be copied; an image forming section 30 configured to form a toner image on a sheet; a fixing section 60 configured to fix the toner image on the sheet; a paper feed section 40 configured to store standard-sized sheets to be conveyed to the image forming section 30; and a conveyance path 50 along which a standard-sized sheet is to be conveyed from the paper feed section 40 or a manual paper feed section 46 via the image forming section 30 and the fixing section 60 to a sheet output port 10E.

Disposed at the top surface of the apparatus body 10 are an original glass plate (not shown) for use in reading an original document sheet automatically fed from the ADF 20 and/or an original glass plate (not shown) for use in reading a manually placed original document sheet. The reading unit 25 is configured to optically read an image of the original document sheet through these original glass plates. The aforementioned automatic document feeder (ADF) 20 and the reading unit 25 constitute an image reading device 2 to be described later.

The image forming section 30 is configured to perform a process for creating a toner image based on a known electrophotographic technique and transferring the toner image to a sheet. In other embodiments, other image forming techniques, such as an ink-jet technique, may be employed.

The image forming section 30 includes a photosensitive drum 321 and further includes an unshown charging device, an unshown exposure device, an unshown developing device, and an unshown cleaning device all of which are disposed around the photosensitive drum 321.

The paper feed section 40 includes two-tired cassettes, i.e., first and second paper feed cassettes 40A and 40B each capable of containing standard-sized sheets. These paper feed cassettes can be pulled outwardly from in front of the apparatus body 10.

The first paper feed cassette 40A includes: a sheet container 41 capable of containing a sheet stack formed of a plurality of stacked standard-sized sheets; and a lift plate 42 configured to lift up the sheet stack for the purpose of paper feeding. Disposed above the right end of the paper feed cassette 40A are an unshown pick-up roller and a roller pair composed of a paper feed roller 44 and a retard roller 45. By the driving of the pick-up roller and the paper feed roller 44, the uppermost sheet of the sheet stack in the paper feed cassette 40A is picked up one by one and introduced to the upstream end of the conveyance path 50. The second paper feed cassette 40B also has the same structure and configuration as the first paper feed cassette 40A.

A manual paper feed section 46 (sheet feeder) is provided at the right side surface 10R of the apparatus body 10. The manual paper feed section 46 includes a manual feed tray 46A (sheet tray) for manual paper feeding and a paper feed roller 461 (conveyance section). The manual feed tray 46A is provided at its lower end with a pair of fulcrum portions 701 and pivotally mounted to the apparatus body 10 so that it is free to open and close relative to the apparatus body 10 with the fulcrum portions 70 as a fulcrum. In performing manual paper feeding, the user opens the manual feed tray 46A as shown in FIG. 1 and places a sheet thereon. The paper feed roller 461 can be driven into rotation and thus feed the sheet in a direction of conveyance of the sheet. By the driving of the paper feed roller 461, the sheet placed on the manual feed tray 46A is introduced to a manual sheet conveyance path 460 (sheet conveyance path) leading out of the manual feed tray 46A. Subsequently, the sheet is introduced through the manual sheet conveyance path 460 to the conveyance path 50.

The conveyance path 50 leads from the paper feed section 40 via the image forming section 30 and the fixing section 60 to the sheet output port 10E. A registration roller pair 51 is disposed in the conveyance path 50 upstream of the transfer nip. The sheet is once stopped between the registration roller pair 51 at rest to correct any skew. Thereafter, the registration roller pair 51 is driven into rotation by a drive section (not shown) with a predetermined timing for image transfer, so that the sheet is forwarded to the transfer nip. In addition, a plurality of unshown sheet conveyance rollers configured to convey the sheet are disposed in the conveyance path 50.

A paper output roller 53 is disposed at the downstream end of the conveyance path 50. The paper output roller 53 is configured to output the sheet through the sheet output port 10E. The sheets output through the sheet output port 10E are discharged to a paper discharge section 10U and piled up thereon.

The fixing section 60 performs a fixing process for fixing the toner image on the sheet. A pressure roller is pressed against an unshown fixing roller, whereby a fixing nip is formed. When the sheet passes through the fixing nip, the toner image transferred to the sheet is fixed on the sheet.

<Sheet Feeder and Sheet Tray>

Figure 3:
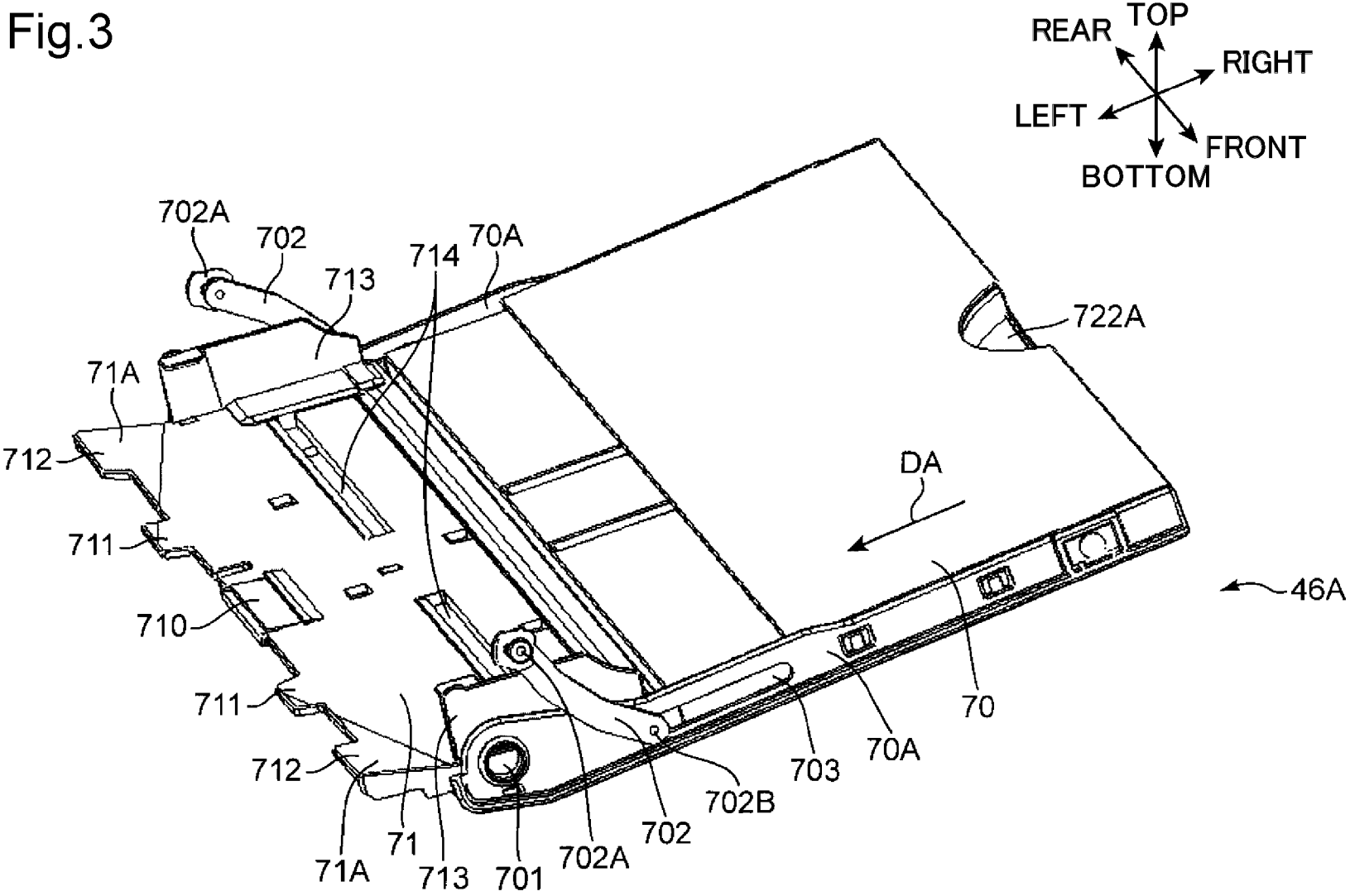
FIG. 3 is another perspective view of the manual feed tray according to the embodiment of the present disclosure.
Figure 4:
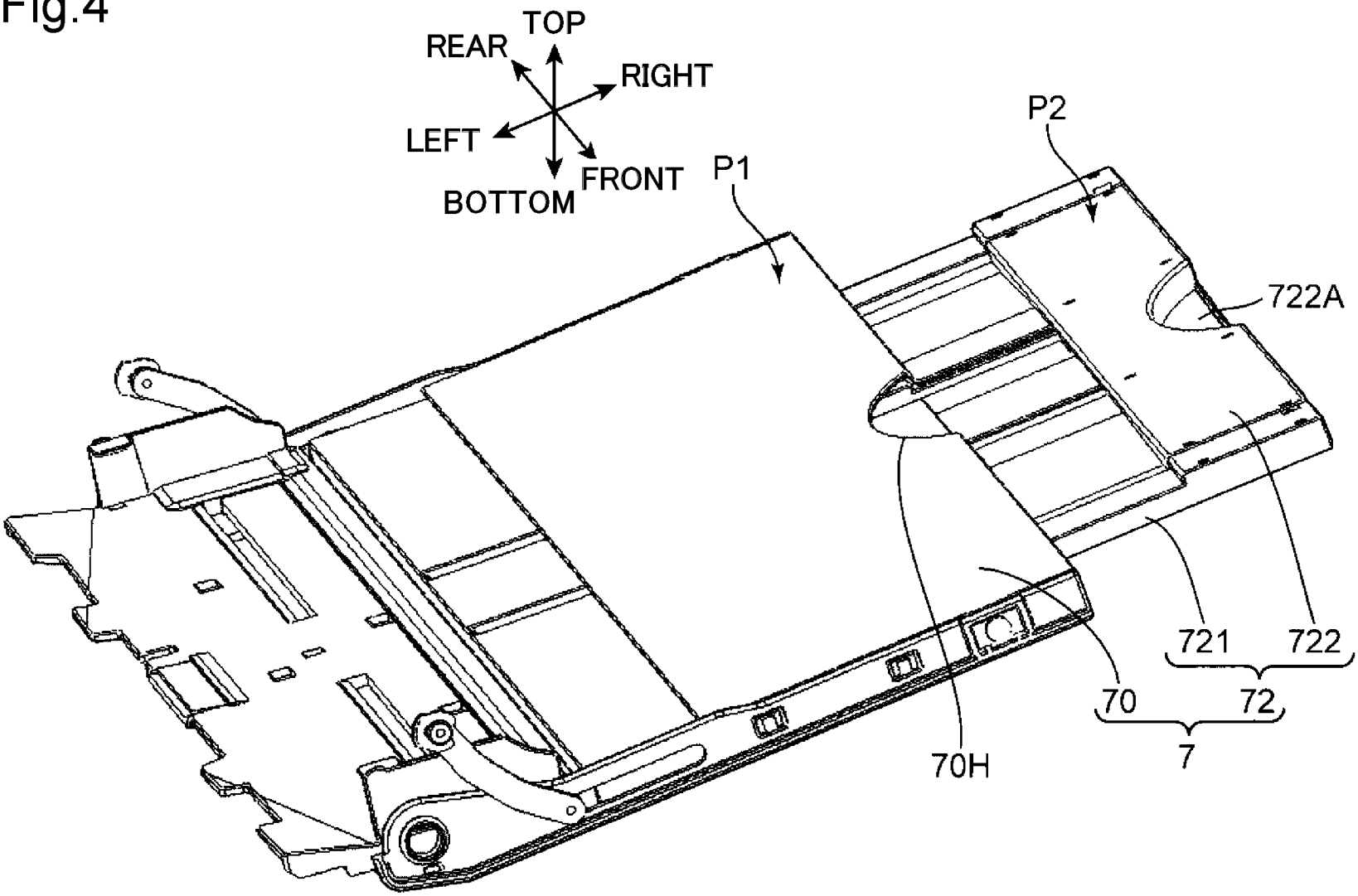
FIG. 4 is a perspective view of the manual feed tray according to the embodiment of the present disclosure in which an auxiliary tray is pulled outward.
Figure 5:
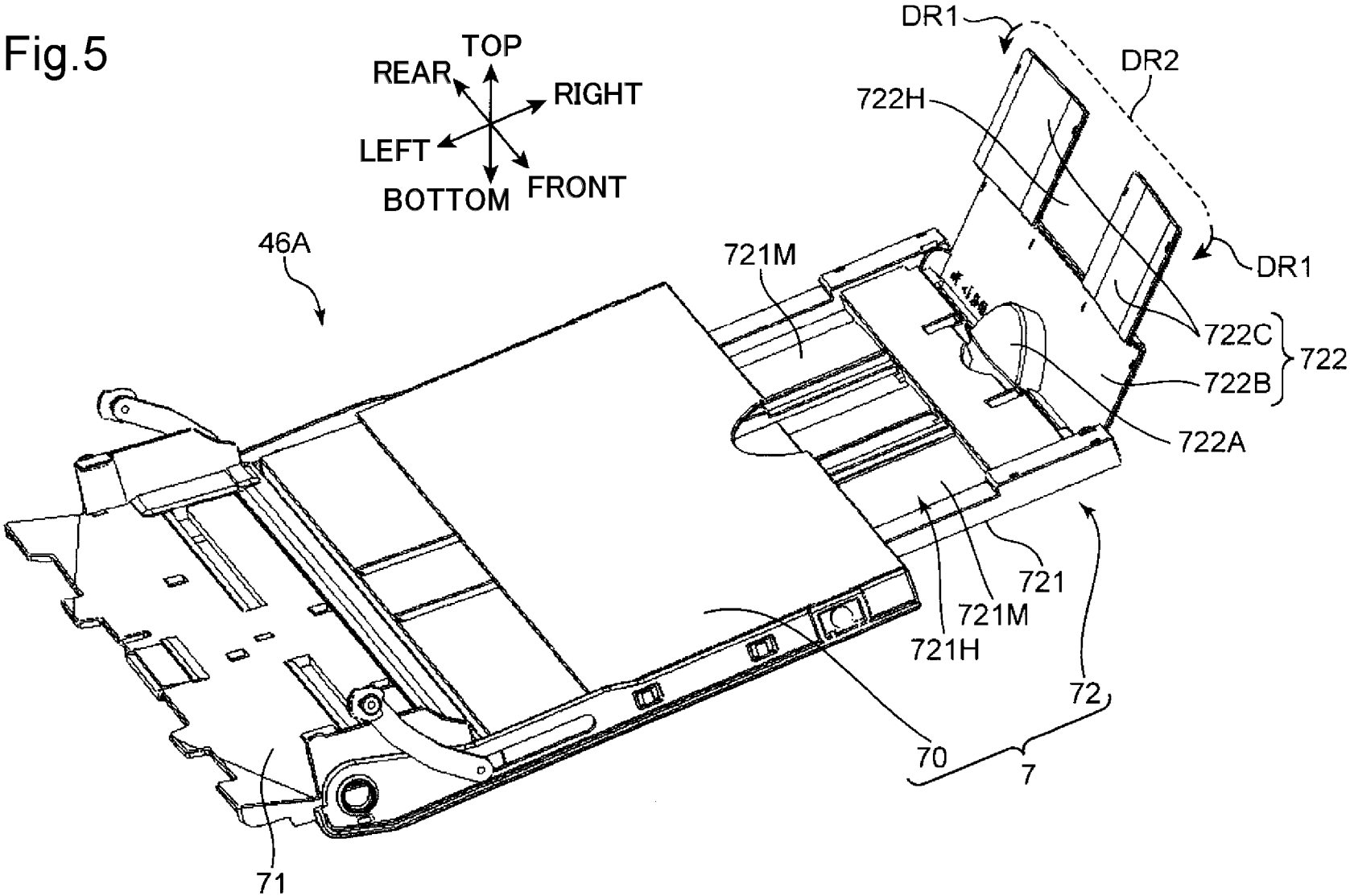
FIG. 5 is a perspective view of the manual feed tray according to the embodiment of the present disclosure in which a second auxiliary tray is opened.
Figure 6A:
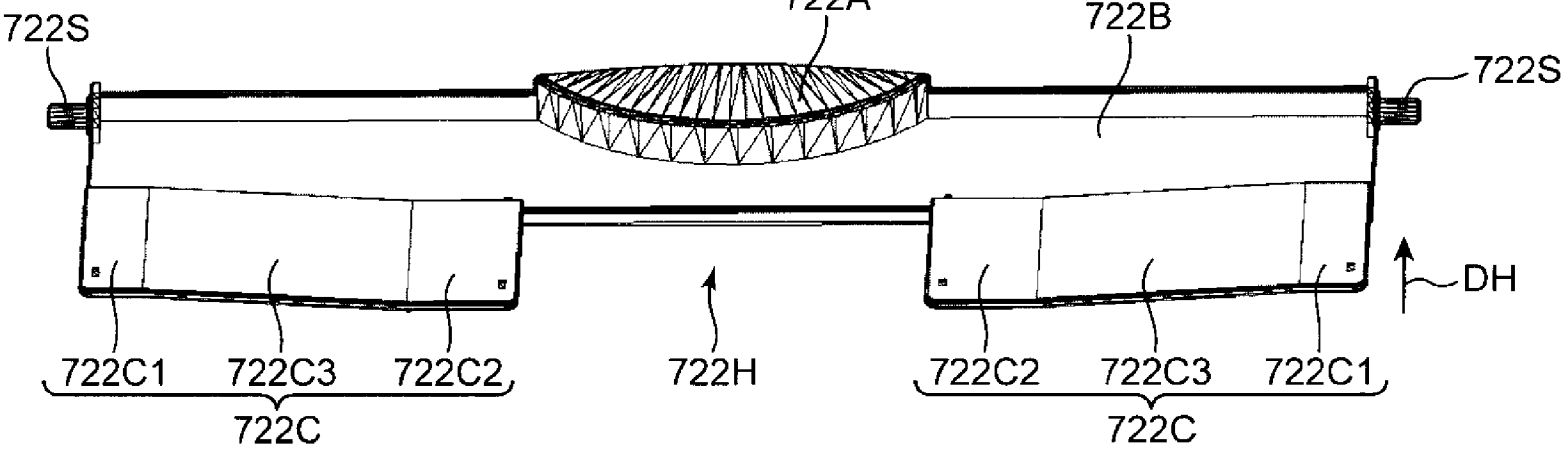
FIG. 6A is a perspective view of the second auxiliary tray of the manual feed tray according to the embodiment of the present disclosure and FIG. 6B is a side view of the second auxiliary tray.
Figure 6B:
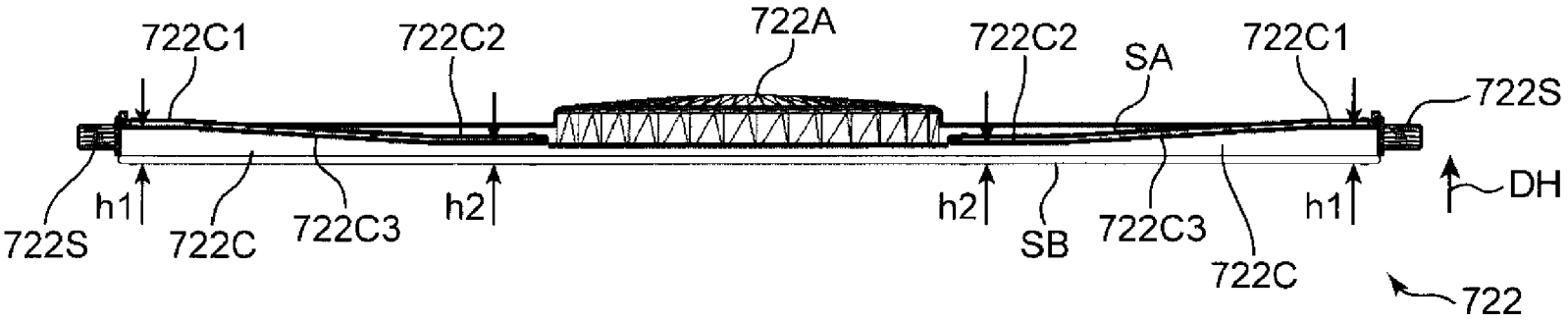

Next, with reference not only to FIG. 1 but also to FIGS. 2 to 6, a detailed description will be given of the structure of the manual feed tray 46A (sheet tray) of the manual paper feed section 46 (sheet feeder) according to this embodiment. FIGS. 2 to 5 are perspective views of the manual feed tray 46A according to this embodiment. FIG. 3 shows a state where an auxiliary tray 72 is retracted in a tray body 70, FIG. 4 shows a state where the auxiliary tray 72 is pulled (extended) outwardly from the tray body 70, and FIG. 5 shows a state where a second auxiliary tray 722 of the auxiliary tray 72 is opened relative to a first auxiliary tray 721 of the auxiliary tray 72. Furthermore, FIG. 6A is a perspective view of the second auxiliary tray 722 and FIG. 6B is a side view thereof.

The manual feed tray 46A includes a tray body 70 and an auxiliary tray 72. The tray body 70 and the auxiliary tray 72 constitute a tray section 7 of the manual feed tray 46A (see FIG. 4). The tray section 7 forms a sheet placement surface (placement surface) which is located at the top surface thereof and on which a sheet with a predetermined width in the front-to-rear direction is to be placed. The tray body 70 is a main body portion of the manual feed tray 46A. The tray body 70 is an approximately rectangular plate-like member extending in the front-to-rear and right-and-left directions. A pair of sidewalls 70A (see FIG. 3) are provided upstandingly at both edges of the tray body 70 in the front-to-rear direction. The tray body 70 includes a pair of fulcrum portions 701, a pair of engaging portions 702 and a pair of guide grooves 703. The tray body 70 further includes a lift plate 71 (forward end portion).

The fulcrum portions 701 serve as a fulcrum of pivotal movement of the manual feed tray 46A relative to the apparatus body 10. Unshown shafts disposed at the right side surface 10R of the apparatus body 10 are inserted into the respective fulcrum portions 701. The engaging portions 702 are arm members mounted to the sidewalls 70A. The engaging portions 702 define at what angle the manual feed tray 46A opens and closes relative to the apparatus body 10. Each engaging portion 702 includes an engagement fulcrum portion 702A and a groove engagement portion 702B. The engagement fulcrum portion 702A is provided at one end of the engaging portion 702 and fastened to an unshown mounting portion disposed at the right side surface 10R of the apparatus body 10. The groove engagement portion 702B is a projection provided at the other end of the engaging portion 702 and inserted into the associated guide groove 703. The guide grooves 703 are grooves formed in the pair of sidewalls 70A to extend in the direction of conveyance of the sheet along the side edges of the sheet placed on the manual feed tray 46A. The groove engagement portions 702B move in and along the associated guide grooves 703 to guide the opening and closing action of the manual feed tray 46A relative to the apparatus body 10. The angle of opening of the manual feed tray 46A is defined by the engagement of the groove engagement portions 702B to the left ends of the guide grooves 703.

The lift plate 71 is formed of a plate-like member disposed on the downstream side of the sheet placement surface of the tray body 70 in the direction of conveyance of the sheet (the direction of the arrow DA in FIG. 3). The lift plate 71 supports the sheet on its top surface and the downstream end thereof in the direction of conveyance of the sheet can be lifted and lowered relative to the tray body 70 by an unshown lifting and lowering mechanism. The sheet placed on the tray body 70, inclusive of the lift plate 71, can be engaged against the paper feed roller 461 (see FIG. 1) by the rising of the downstream end of the lift plate 71. In other words, the lift plate 71 extends along one end edge of the sheet placed on the sheet placement surface of the tray section 7 and in the width direction of the sheet and supports the sheet. The lift plate 71 includes a paper feed pad 710, a pair of inner guide tongues 711, a pair of outer guide tongues 712, a pair of cursors 713, and a pair of cursor guide grooves 714.

The paper feed pad 710 is disposed in the middle of the lift plate 71 in the width direction of the sheet (the front-to-rear direction) and at the forward end of the lift plate 71 in the direction of conveyance of the sheet (the longitudinal direction of the sheet). The paper feed pad 710 prevents multifeed of the sheets. The paper feed pad 710 is made of rubber material. The inner guide tongues 711 are a pair of tongues projecting in the direction of conveyance of the sheet from the downstream end edge of the lift plate 71 in the direction of conveyance of the sheet. The inner guide tongues 711 are provided on both sides of the paper feed pad 710 in the width direction of the sheet. The outer guide tongues 712 are a pair of tongues provided outwardly of the inner guide tongues 711 in the width direction of the sheet, or at both ends of the lift plate 71 in the width direction of the sheet, and projecting in the direction of conveyance of the sheet. The inner guide tongues 711 and the outer guide tongues 712 have the function of guiding the sheet conveyed from the manual feed tray 46A.

The pair of cursors 713 are arranged inwardly of the pair of engaging portions 702 and are movable in the front-to-rear direction relative to the lift plate 71. The cursors 713 define the widthwise position of the sheet to be placed on the tray body 70. The cursors 713 can be moved in the front-to-rear direction along the cursor guide grooves 714 in the lift plate 71 by an unshown rack and pinion mechanism.

Referring also to FIGS. 4 and 5, the auxiliary tray 72 can be pulled to the right from the tray body 70. Therefore, an unshown space capable of accommodating the auxiliary tray 72 is formed inside the tray body 70. The user of the manual feed tray 46A holds a grip 722A formed in the auxiliary tray 72 and pulls the auxiliary tray 72 outwardly from the tray body 70. The tray body 70 has a semicircular cutaway 70H formed therein in a complementary relationship with the grip 722A. When the auxiliary tray 72 is extended (pulled) outwardly from the tray body 70, a longer sheet can be placed on the manual feed tray 46A. In other words concerning the tray body 70 and the auxiliary tray 72, the aforementioned tray body 70 allows a sheet with a first length in the direction of conveyance of the sheet (the length direction of the sheet) to be placed thereon and the auxiliary tray 72 can be extended from the tray body 70 in the length direction of the sheet to move away from the lift plate 71. The auxiliary tray 72 allows a sheet with a second length longer than the first length to be placed across the tray body 70 and the auxiliary tray 72.

The auxiliary tray 72 includes a first auxiliary tray 721 and a second auxiliary tray 722. The first auxiliary tray 721 is supported by the tray body 70 to be capable of being extended in the length direction of the sheet from the tray body 70 and disposed in parallel with the tray body 70. The dimension of the first auxiliary tray 721 in the width direction of the sheet is set smaller than the tray body 70. The second auxiliary tray 722 is disposed to lie over the first auxiliary tray 721. Referring to FIGS. 4 and 5, the second auxiliary tray 722 is supported by the first auxiliary tray to be capable of being opened (unfolded in this embodiment) relative to the first auxiliary tray and can be changed between an open position (see FIG. 5) in which the second auxiliary tray 722 is extended at least in the length direction of the sheet from the first auxiliary tray 721 and a closed position (see FIG. 4) in which the second auxiliary tray 722 is laid over the first auxiliary tray 721 and is ready to be retracted into the tray body 70 together with the first auxiliary tray 721. Note that the expression "extended at least in the length direction of the sheet" means, in this embodiment, that the second auxiliary tray 722 is extended not only in the length direction of the sheet in which the first auxiliary tray 721 is extended from the tray body 70 but also upwardly. In another embodiment, the second auxiliary tray 722 in the open position may be extended only in the length direction of the sheet and disposed in parallel with the tray body 70, like the first auxiliary tray 721. The second auxiliary tray 722 includes a pair of second auxiliary tray shafts 722S (see FIG. 6). The second auxiliary tray shafts 722S are a pair of shafts disposed close to an edge of the second auxiliary tray 722 facing the first auxiliary tray 721 and at both ends thereof in the width direction of the sheet. The change in position of the second auxiliary tray 722 is implemented by pivotal movement thereof about the second auxiliary tray shafts 722S as a fulcrum.

Referring to FIGS. 5 and 6, the second auxiliary tray 722 includes a plate portion 722B and an extension plate 722C (rear end portion). The plate portion 722B is a main body portion of the second auxiliary tray 722 and is formed of a plate-like member connected to the first auxiliary tray 721. The aforementioned grip 722A is formed so that the surface of the plate portion 722B facing the first auxiliary tray 721 (or the semicircular cutaway 70H) is depressed at a midportion in the width direction of the sheet into a semicircular dent. Owing to the semicircular dent, the grip 722A rises on the sheet placement surface of the plate portion 722B when the plate portion 722B is in a position shown in FIG. 5. Furthermore, when the first and second auxiliary trays 721 and 722 are retracted in the tray body 70, the grip 722A coincides with the semicircular cutaway 70H to form the same cutaway shape.

The extension plate 722C is a plate-like member extending from the plate portion 722B. In the open position of the second auxiliary tray 722 shown in FIG. 5, the extension plate 722C extends from the plate portion 722B in a direction away from the lift plate 71. Therefore, in the open position of the second auxiliary tray 722, the extension plate 722C supports the trailing end portion of the sheet on the side of the tray body 70 opposite the lift plate 71 in the length direction of the sheet. Furthermore, a sheet sinking-back portion 722H (cutout portion) is formed in the middle of the extension plate 722C in the width direction of the sheet (the front-to-rear direction). In other words, the sheet sinking-back portion 722H is formed by partly cutting away a midportion of the extension plate 722C of the plate-like second auxiliary tray 722 in the width direction of the sheet.

Referring to FIG. 6, the extension plate 722C of the second auxiliary tray 722 in this embodiment has a shape inclined in the width direction of the sheet. Specifically, the extension plate 722C includes a pair of outside supporting portions 722C1, a pair of inside supporting portions 722C2, and a pair of intermediate portions 722C3. Each outside supporting portion 722C1 is a region of the extension plate 722C located outwardly in the width direction of the sheet and each inside supporting portion 722C2 is a region of the extension plate 722C located inwardly in the width direction of the sheet. Each intermediate portion 722C3 joins the adjacent outside supporting portion 722C1 and inside supporting portion 722C2 in the width direction of the sheet. The outside supporting portions 722C1 and the inside supporting portions 722C2 are provided substantially horizontally and the intermediate portions 722C3 are inclined. The inside supporting portions 722C2 adjoin the sheet sinking-back portion 722H in the width direction of the sheet. The outside supporting portions 722C1 are raised, relative to the inside supporting portions 722C2, in the direction (the direction of the arrow DH in FIG. 6) perpendicular to the sheet placement surface of the plate portion 722B (the surface of the sheet placed on the plate portion 722B). Specifically, the outside supporting portions 722C1 are raised on the sheet placement surface side relative to the inside supporting portions 722C2. Referring to FIG. 6B, where h1 represents the height of the outside supporting portions 722C1 from the surface SB of the second auxiliary tray 722 opposite the surface SA thereof on which the sheet is to be placed and h2 represents the height of the inside supporting portions 722C2 from the surface SB, the relationship h1>h2 is satisfied. In other words concerning the above relationship, both ends of the extension plate 722C of the second auxiliary tray 722 in the width direction of the sheet are raised perpendicularly to the sheet surface relative to the middle of the extension plate 722C in the width direction of the sheet.

To conform to the above shape of the extension plate 722C, a left part of the first auxiliary tray 721 is provided with an accommodating portion 721H (see FIG. 5) formed by partly depressing the first auxiliary tray 721 along the front-to-rear and right-and-left directions. The accommodation of the extension plate 722C in the accommodating portion 721H reduces the thickness of the auxiliary tray 72 when the first and second auxiliary trays 721 and 722 are laid one over another (folded together). A pair of tapered surfaces 721M are provided in regions of the first auxiliary tray 721 defining the bottom surface of the accommodating portion 721H. The pair of tapered surfaces 721M are formed of inclined surfaces lowering from the middle toward both ends of the first auxiliary tray 721 in the width direction of the sheet. The inclined surfaces conform to the inclination from the outside supporting portions 722C1 to the inside supporting portions 722C2. The tapered surfaces 721M allow the extension plate 722C to be accommodated in the accommodating portion 721H so that the thickness of the auxiliary tray 72 can be reduced as much as possible.

When the auxiliary tray 72 is pulled outwardly to the right from the tray body 70 and the second auxiliary tray 722 is then opened (unfolded) relative to the first auxiliary tray 721 and pivotally moved downward from the position shown in FIG. 5, the second auxiliary tray 722 takes a position extended substantially upward at a predetermined angle from the first auxiliary tray 721 and is thus ready for a sheet to be placed thereon. Therefore, in the case where a sheet with a length not less than the combined length of the tray body 70 and the first auxiliary tray 721 is placed on the manual feed tray 46A, the trailing end portion of the sheet in the direction of conveyance of the sheet is disposed to take an upward curve. Thus, the space around the manual feed tray 46A occupied by the sheet can be reduced as much as possible in the length direction of the sheet. In other words, as compared with the case where the length of the manual feed tray 46A is set to correspond to the length of a longest sheet to be placed on the manual feed tray 46A, the projection length L of the tray shown in FIG. 1 can be reduced.

Furthermore, for the sheet placed on the manual feed tray 46A, a portion of the sheet leaning against the extension plate 722C forms a sag along the inclined shape of the extension plate 722C. As described previously, the outside supporting portions 722C1 are raised perpendicularly to the surface of the placed sheet (in the direction of the arrow DH in FIG. 6) relative to the inside supporting portions 722C2. Therefore, both widthwise ends of the sheet supported by the extension plate 722C are pushed in the directions of the arrows DR1 in FIG. 5 by the outside supporting portions 722C1. As a result, the trailing end portion of the sheet is given a deflection shape as shown in the arrow DR2 in FIG. 5 so that both widthwise ends of the sheet are warped forward relative to the widthwise middle of the sheet. Furthermore, as described previously, the sheet sinking-back portion 722H is provided in the extension plate 722C in this embodiment. Therefore, when the sheet is being given the above deflection shape, the widthwise mid-portion of the sheet can slightly sink in the sheet sinking-back portion 722H. As a result, the sag of the sheet can be more easily formed.

In the above manner, in the open position of the second auxiliary tray 722, the sheet placed on the manual feed tray 46A forms a sag along the width direction of the sheet. As a result, the sheet is less likely to sag along the length direction of the sheet, so that the trailing end portion (the other end portion) of the sheet extending beyond the extension plate 722C to the outside of the tray section 7 is less likely to droop from the tray section 7. Thus, even if the sheet longer than the length of the tray section 7 is placed on the manual feed tray 46A, the sheet can be prevented from falling and can be stably supported. Particularly, the trailing end portion of the sheet is curved upward by the second auxiliary tray 722 put in the open position and both widthwise ends of the trailing end portion of the sheet are further curved to move toward the lift plate 71 by the shape of the extension plate 722C. As a result, the curvature of the sheet caused by the second auxiliary tray 722 and the sag of the sheet caused by the extension plate 722C provide a synergistic effect that the sheet becomes still less likely to fall from the tray section 7.

Figure 7:
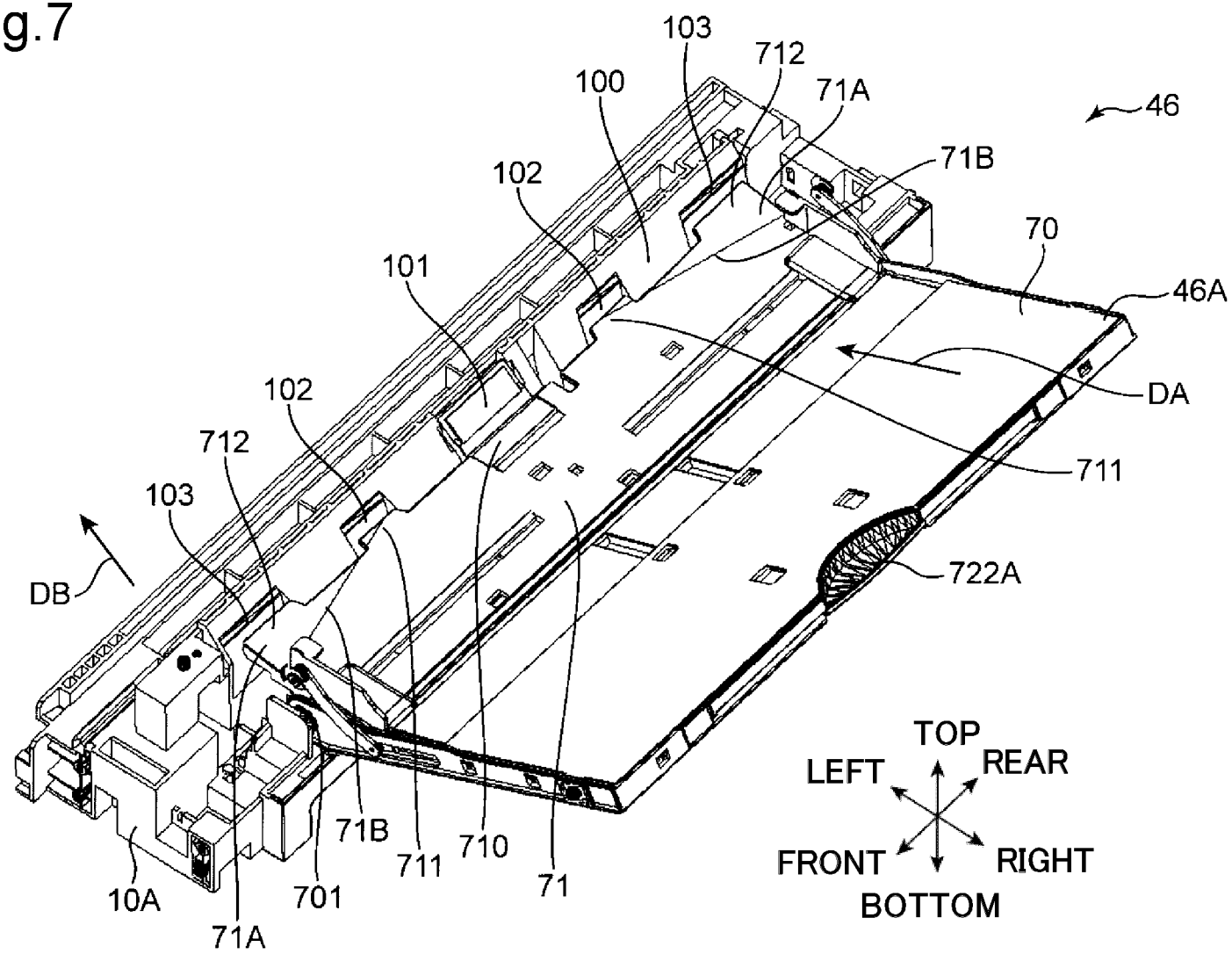
FIG. 7 is a perspective view of a manual paper feed section according to the embodiment of the present disclosure.
Figure 8:
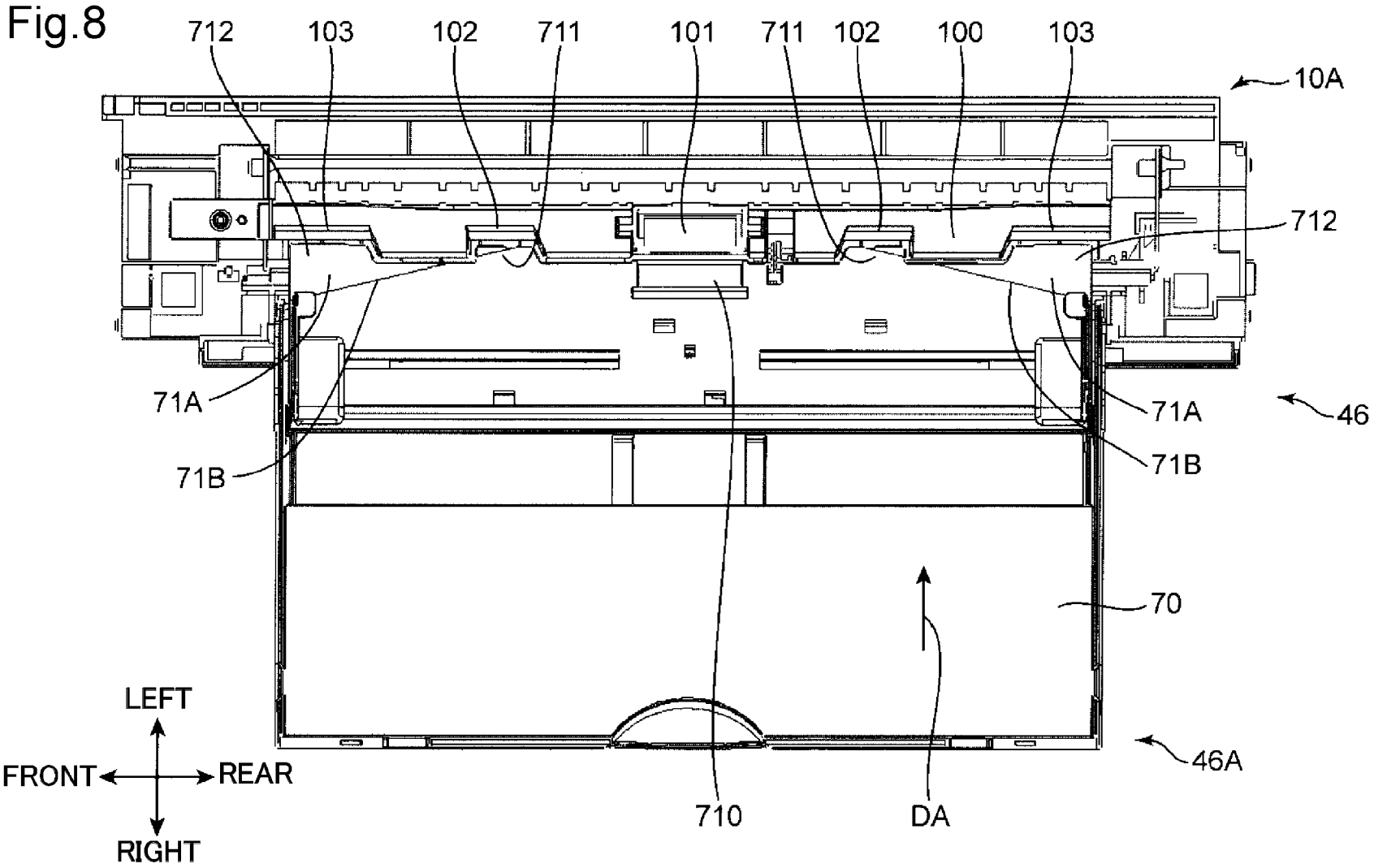
FIG. 8 is a plan view of the manual paper feed section according to the embodiment of the present disclosure.
Figure 9A:
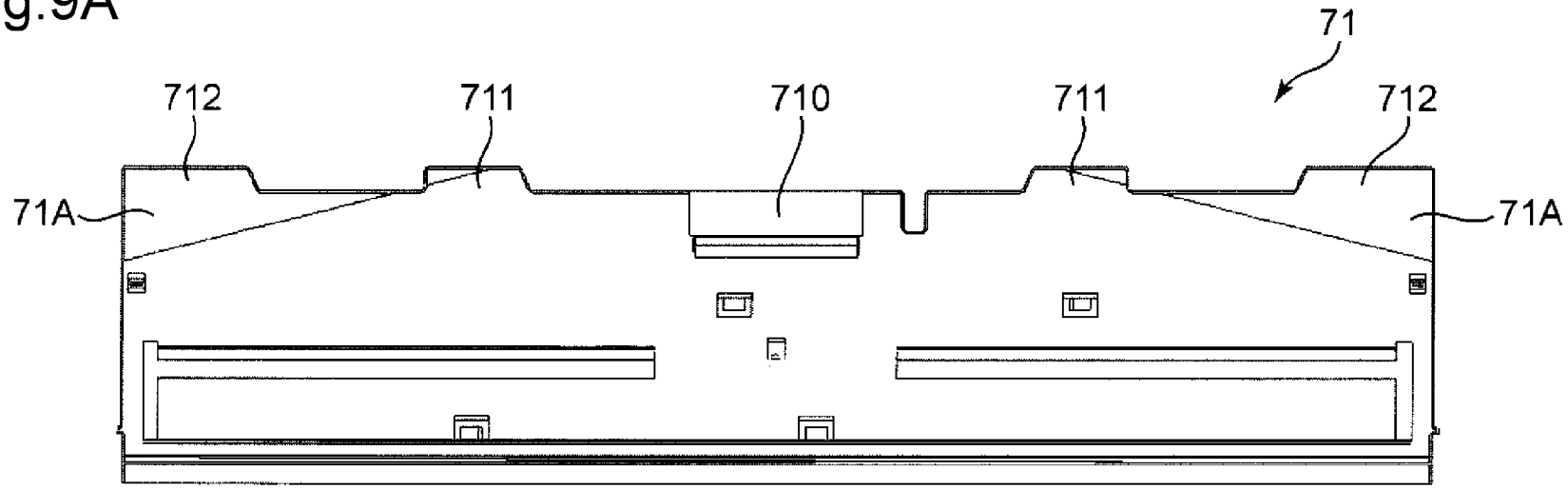
FIG. 9A is a plan view of a lift plate according to the embodiment of the present disclosure and FIG. 9B is a side view of the lift plate.
Figure 9B:
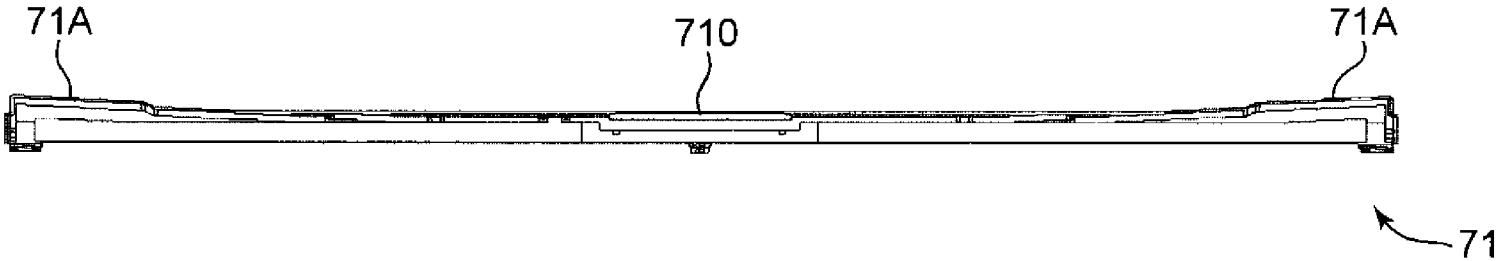
Figure 10:
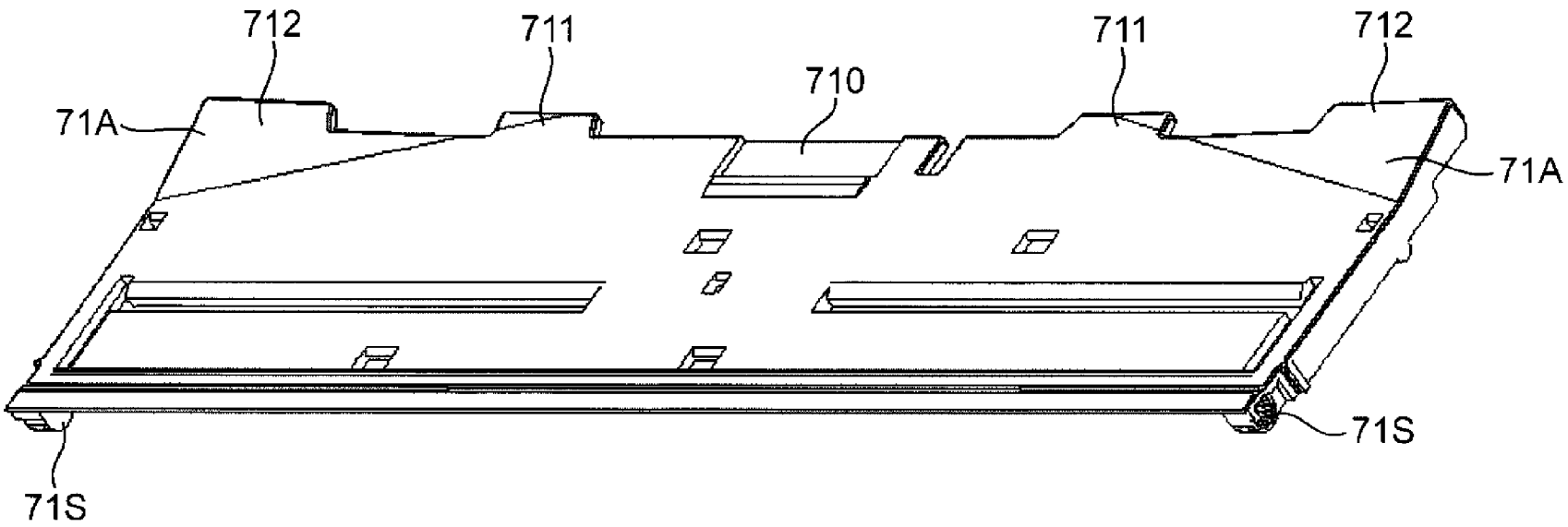
FIG. 10 is a perspective view of the lift plate according to the embodiment of the present disclosure.
Figure 11:
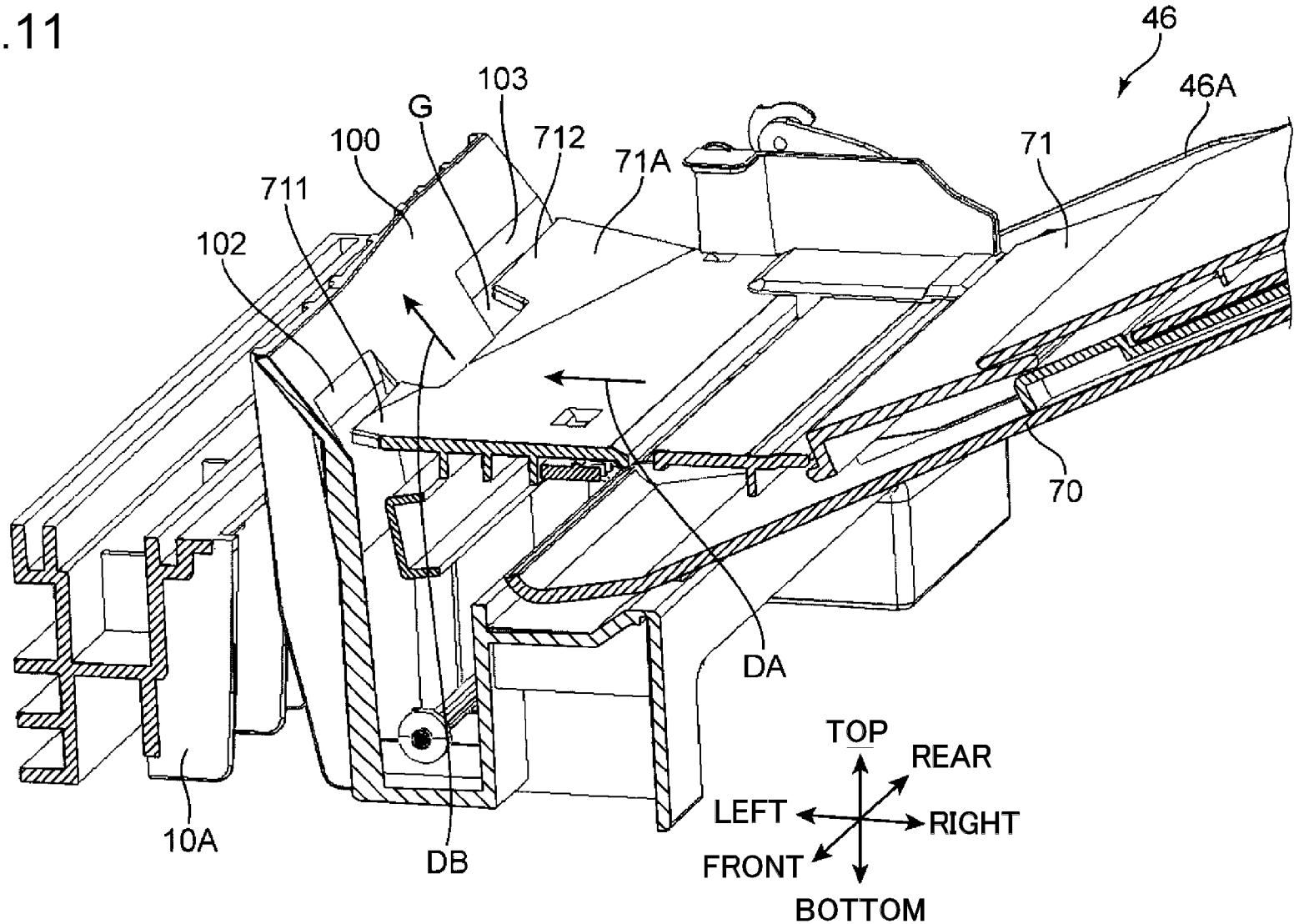
FIG. 11 is a cross-sectional perspective view of the manual paper feed section according to the embodiment of the present disclosure.

Next, with reference to FIGS. 7 to 11, a further detailed description will be given of the manual paper feed section 46 according to this embodiment. FIG. 7 is a perspective view of the manual paper feed section 46 according to this embodiment. FIG. 8 is a plan view of the manual paper feed section 46. FIG. 9A is a plan view of the lift plate 71 in this embodiment of the present disclosure and FIG. 9B is a side view thereof. FIG. 10 is a perspective view of the lift plate 71. FIG. 11 is a cross-sectional perspective view of the manual paper feed section 46.

Referring to FIG. 7, the manual paper feed section 46 includes an introduction section 10A. The introduction section 10A is disposed in a region of the right side surface 10R of the apparatus body 10 (see FIG. 1) facing the manual feed tray 46A. The introduction section 10A corresponds to a portion of the housing of the apparatus body 10. The introduction section 10A is an approximately cuboidal housing having a predetermined width in the right-and-left direction and extending in the front-to-rear direction. As shown in FIG. 7, the aforementioned fulcrum portions 701 of the manual feed tray 46A are supported by portions of the introduction section 10A.

The introduction section 10A includes a guide portion 100. The guide portion 100 is a wall portion disposed facing the lift plate 71 of the manual feed tray 46A. The guide portion 100 is disposed a predetermined gap G away from the lift plate 71 in the direction of conveyance of the sheet (see FIG. 11). The guide portion 100 is configured to guide the sheet, having been conveyed by the paper feed roller 461 (see FIG. 1), in the direction (see the arrow DB in FIGS. 7 and 11) intersecting with the lift plate 71 as viewed in section transverse to the width direction of the sheet.

The guide portion 100 includes a guide pad 101, a pair of inner cutaways 102, and a pair of outer cutaways 103.

The guide pad 101 is disposed in the middle of the guide portion 100 in the width direction of the sheet (the front-to-rear direction). The guide pad 101 is made of rubber material like the paper feed pad 710. The guide pad 101 forms a conveyance nip together with the peripheral surface of the aforementioned paper feed roller 461. The paper feed roller 461 is disposed above the downstream end edge of the manual feed tray 46A in the direction of conveyance of the sheet and facing the middle of the end edge of the manual feed tray 46A in the width direction of the sheet. In other words, the paper feed roller 461 is disposed facing a region where the paper feed pad 710 and the guide pad 101 intersects with each other. Thus, the peripheral surface of the paper feed roller 461 forms the paper feed nip and the conveyance nip with the paper feed pad 710 and the guide pad 101, respectively. Therefore, the sheet can be conveyed from the direction of conveyance of the sheet (the direction of the arrow DA) in FIG. 7 along the guide portion 100 toward the direction of guide of the sheet (the direction of the arrow DB).

The inner cutaways 102 are a pair of cutaways provided in the guide portion 100 outwardly of the guide pad 101 in the front-to-rear direction. The inner cutaways 102 are provided facing the inner guide tongues 711 of the lift plate 71. Furthermore, the inner guide tongues 711 are arranged to enter the inner cutaways 102. Likewise, the outer cutaways 103 are a pair of cutaways provided in the guide portion 100 outwardly of the inner cutaways 102 in the front-to-rear direction. In other words, the outer cutaways 103 are provided at both ends of the guide portion 100 in the front-to-rear direction. The outer cutaways 103 are provided facing the outer guide tongues 712 of the lift plate 71. Furthermore, the outer guide tongues 712 are arranged to enter the outer cutaways 103.

In other words, the inner guide tongues 711 and outer guide tongues 712 of the lift plate 71 are a plurality of tongues projecting toward the guide portion 100 from the end edge of the lift plate 71 facing the guide portion 10 and arranged along the width direction of the sheet. Furthermore, since the inner guide tongues 711 and the outer guide tongues 712 are arranged to enter the inner cutaways 102 and the outer cutaways 103, respectively, of the guide portion 100, the mutual comb shapes of the guide portion 100 and the lift plate 71 intermate with each other while leaving the gap G therebetween. Thus, the passing of the sheet from the lift plate 71 to the guide portion 100 can be suitably implemented.

The lift plate 71 in this embodiment further includes a pair of end guides 71A. The end guides 71A are formed so that both ends of the end edge of the lift plate 71 facing the guide portion 100 are raised in the direction of guide of the guide portion 100 relative to the middle of the end edge thereof in width direction of the sheet. In other words, both ends of the lift plate 71 in the width direction of the sheet are raised perpendicularly to the sheet placement surface of the tray body 70 (on the sheet placement surface side) relative to the middle of the lift plate 71 in the width direction of the sheet. More specifically, the end guides 71A are formed by bending both ends of the end edge of the lift plate 71 in the width direction of the sheet to form planes intersecting with both the direction of conveyance of the sheet (the arrow DA in FIG. 7) and the width direction of the sheet (the front-to-rear direction). In this case, bending lines 71B are formed at the root ends of the end guides 71A. In this manner, the end guides 71A can be stably formed by an inexpensive bending process. Furthermore, in this embodiment, each end guide 71A includes the aforementioned outer guide tongue 712. Therefore, the outer guide tongues 712 disposed at both ends of the lift plate 71 in the width direction of the sheet are raised (elevated) in the direction of guide relative to the inner guide tongues 711 disposed closer to the middle of the lift plate 71 in the width direction of the sheet. In still other words, the end guides 71A are faces of the lift plate 71 formed so that at one end edge of the lift plate 71 located downstream in the direction of conveyance of the sheet, portions of the sheet placement surface (top surface) located at both ends of the one end edge in the width direction of the sheet are inclined in the direction of guide of the guide portion 100. Furthermore, each end guide 71A is formed of a right triangle, as viewed from above, having a right-angled vertex at the corner of the lift plate 71 in the width direction of the sheet, two sides formed of the aforementioned one end edge of the lift plate 71 and a side edge thereof along the direction of conveyance of the sheet, and the hypotenuse (bending line 71B) extending on the sheet placement surface.

Figure 12:
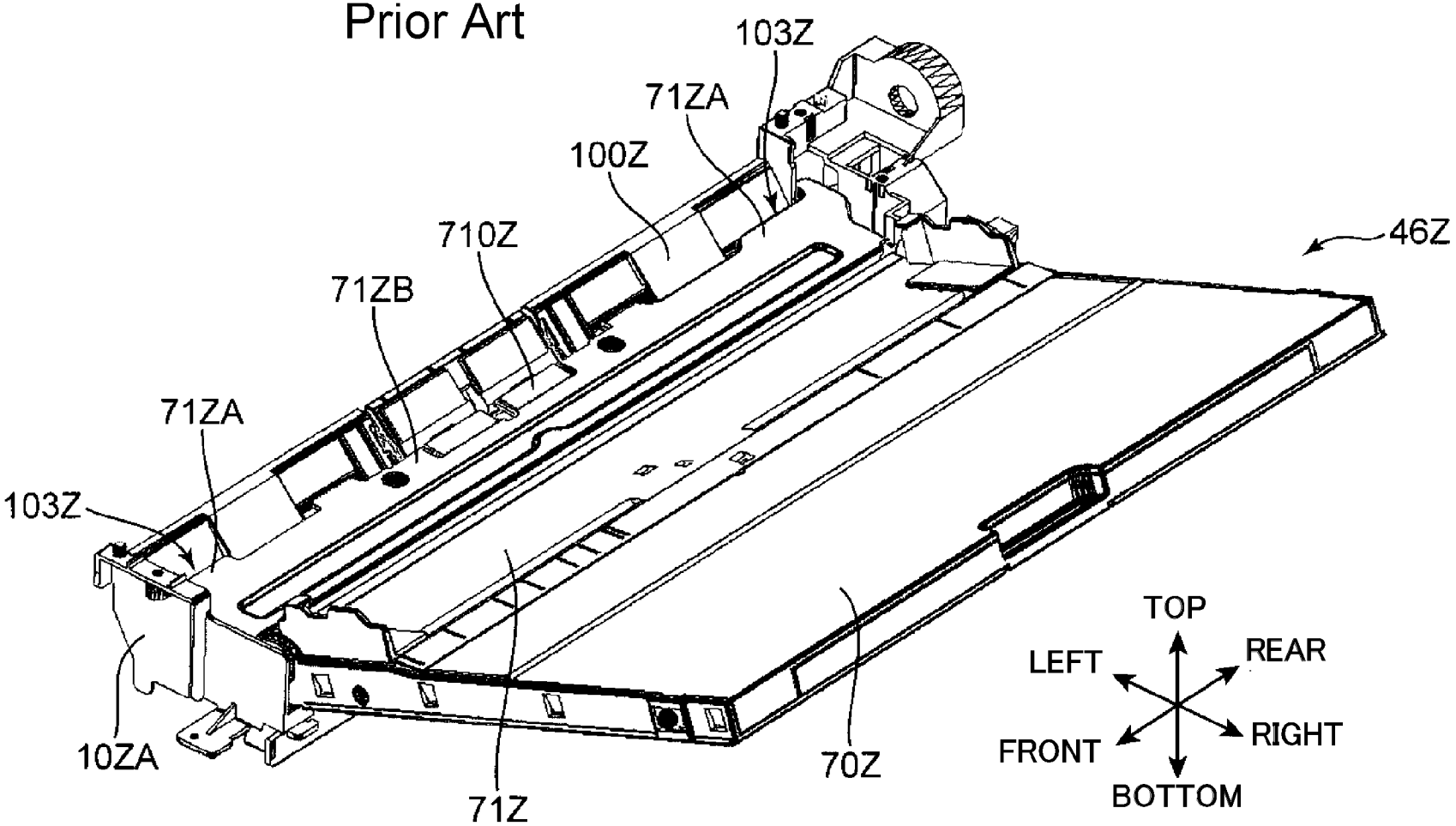
Fig.12 Prior Art
FIG. 12 is a perspective view of another manual paper feed section for comparison with the manual paper feed section according to the embodiment of the present disclosure.

Next, with reference not only to FIG. 11 but also FIG. 12, a description will be given of the function of the end guides 71A in this embodiment. FIG. 12 is a perspective view of another manual paper feed section 46Z for comparison with the manual paper feed section 46 according to this embodiment. The manual paper feed section 46Z, like the manual paper feed section 46, includes a tray body 70Z and a lift plate 71Z. Furthermore, an introduction section 10ZA provided in an unshown apparatus body is disposed facing the lift plate 71Z. The introduction section 10ZA includes a guide portion 100Z. Unlike the lift plate 71 in this embodiment, the lift plate 71Z does not include the end guides 71A. In other words, a midportion 71ZB and end portions 71ZA of the lift plate 71Z located at one end edge thereof facing the guide portion 100Z are formed flush with each other.

When in the manual paper feed section 46Z having the above structure a sheet is conveyed by an unshown paper feed roller disposed facing a paper feed pad 710Z, the widthwise middle of the sheet is surely conveyed toward the guide portion 100Z by the paper feed roller. On the other hand, both widthwise ends of the sheet not engaged against the paper feed roller are free from constraint and therefore likely to weigh themselves down. As a result, both ends of the sheet are likely to enter a gap 103Z between the lift plate 71Z and the guide portion 100Z to cause sheet creases or a sheet conveyance failure.

In contrast, in the manual paper feed section 46 according to this embodiment, as shown in FIG. 11, the end guides 71A are disposed at both ends of the lift plate 71 in the width direction of the sheet where the force of constraint of the sheet tends to decrease. Therefore, the sheet ends are guided by the end guides 71A to approach the guide portion 100. In other words, the sheet ends are guided upward away from the gap G. Therefore, unlike the manual paper feed section 46Z, the occurrence of sheet creases and a sheet conveyance failure can be suitably prevented. Particularly, the lift plate 71 vertically moves to engage the sheet against the paper feed roller 461. Therefore, in the case where a large number of sheets are stacked on the manual feed tray 46A, the lift plate 71 is located at a level still lower than the guide portion 100. Thus, the sheets might be more likely to enter the gap G toward a lower portion of the gap G. However, in this embodiment, the end guides 71A are raised upward (elevated) to such a degree that even if the lift plate 71 is located at the lowermost level, the end guides 71A can prevent the sheet from entering the gap G.

Since the end guides 71A have the above shape, they can produce a synergistic effect with the aforementioned extension plate 722C. Specifically, the end guides 71A and the extension plate 722C give to the sheet placed on the manual feed tray 46A a deflection shape in the same orientation throughout the length of the sheet. Therefore, the sheet can be easily introduced into the guide portion 100 along the end guides 71A. Furthermore, since the leading end portion of the sheet is also given a deflection shape by the end guides 71A, the trailing end portion of the sheet can be easily given a deflection shape by the extension plate 722C. As a result, even if a sheet longer than the maximum length of the manual feed tray 46A is placed on the manual feed tray 46A, the sheet can be further prevented from falling from the manual feed tray 46A.

Although the manual paper feed section 46 (manual feed tray 46A) and the image forming apparatus 1 with the same according to the embodiment of the present disclosure have thus far been described, the scope of the present disclosure is not limited to the above embodiment and can include, for example, the following modified embodiments.

(1) Although the above embodiment has been described using the manual feed tray 46A and the manual paper feed section 46 as the sheet tray and the sheet feeder, respectively, the scope of the present disclosure is not limited to them. The scope of the present disclosure includes an embodiment in which an original document tray 21 (sheet tray) of the automatic document feeder 20 (sheet feeder) is applied as the sheet tray on which a sheet longer than the tray size may be placed. In this case, the aforementioned reading unit 25 (reading section) and the automatic document feeder 20 constitute an image reading device 2. Even if an original document longer than the tray section of the original document tray 21 is placed on the tray section, the original document can be stably supported by the original document tray 21. As a result, the original document is stably conveyed from the original document tray 21 to the sheet conveyance path of the automatic document feeder 20 and the image of the original document is suitably read by the reading unit 25 disposed facing the sheet conveyance path.

(2) Although the above embodiment has been described about an example in which the extension plate 722C has a shape capable of giving a sag to a sheet, the scope of the present disclosure is not limited to this. In another embodiment, an end (P1 in FIG. 4) of the tray body 70 in the length direction of the sheet or an end (P2 in FIG. 4) of the second auxiliary tray 722 in the closed position in the length direction of the sheet may have the same shape as the extension plate 722C.

(3) Although the above embodiment has been described about an example in which the outside supporting portions 722C1 are raised, relative to the inside supporting portions 722C2, perpendicularly to the sheet placement surface of the plate section 722B and on the sheet placement surface side, the scope of the present disclosure is not limited to this. In another embodiment, the outside supporting portions 722C1 may be raised, relative to the inside supporting portions 722C2, perpendicularly to the sheet placement surface of the plate section 722B and on the side opposite the sheet placement surface. Also in this case, a sag along the width direction of the sheet is formed on the sheet. Therefore, a sag along the length direction of the sheet is less likely to be formed and the sheet can be suitably prevented from falling from the manual feed tray 46A (sheet tray).

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A sheet tray comprising a tray section including a placement surface on which a sheet is to be placed, wherein a rear end portion of the tray section, capable of supporting an upstream side of the sheet in a conveyance direction, extends in a width direction of the sheet perpendicular to the sheet conveyance direction, both ends of the rear end portion in the width direction are raised upward to the placement surface relative to the middle of the rear end portion in the width direction of the sheet, the tray section comprises:

a tray body allowing a sheet with a first length in the sheet conveyance direction to be placed thereon; and an auxiliary tray capable of being extended from an upstream end of the tray body in the sheet conveyance direction toward upstream in the sheet conveyance direction, the auxiliary tray allowing an upstream side of a sheet with a second length longer than the first length to be placed thereon, the tray section allows the sheet with the second length to be placed thereon when the auxiliary tray is extended, the auxiliary tray comprises:

a first auxiliary tray supported on the tray body to be capable of being extended from the tray body toward upstream side of the sheet conveyance direction and disposed in parallel with the tray body; and a second auxiliary tray pivotally supported at a downstream end thereof in the sheet conveyance direction on an upstream end of the first auxiliary tray in the sheet conveyance direction, the second auxiliary tray being changeable between an open position in which the second auxiliary tray is pivotally moved from the first auxiliary tray toward upstream in the sheet conveyance direction so as to be spread out and a closed position in which the second auxiliary tray is pivotally moved from the first auxiliary tray toward downstream in the sheet conveyance direction so as to be folded over the first auxiliary tray, the second auxiliary tray in the closed position being capable of being retracted together with the first auxiliary tray into the tray body, the rear end portion of the tray section is disposed at the second auxiliary tray, the rear end portion of the tray section includes a pair of extension plates wherein each of the extension plates includes an outside supporting portion located outwardly in the width direction of the sheet and an inside supporting portion located inwardly in the width direction of the sheet, with each of the extension plates further including an inclined shape formed by the outside supporting portion being raised on the sheet placement surface side relative to the inside supporting portion, the first auxiliary tray is provided at a downstream side thereof in the sheet conveyance direction with an accommodation portion in which the rear end portion of the tray section is accommodated when the second auxiliary tray is in the closed position, the accommodation portion conforms in its shape to the inclined shape of each of the extension plates at the bottom surface thereof and includes a pair of tapered surfaces inclining from the middle toward both ends in the width direction of the sheet, a space capable of accommodating the auxiliary tray is formed inside the tray body, and the second auxiliary tray in the closed position is capable of being accommodated together with the first auxiliary tray in the space.

2. The sheet tray according to claim 1, wherein a part of midportion of the rear end portion in the width direction of the sheet has a cutout portion formed therein by partly cutting away the tray section.

3. The sheet tray according to claim 1, wherein a forward end portion of the tray section is capable of supporting a downstream side of the sheet in the direction of conveyance of the sheet, both ends of the forward end portion in the width direction of the sheet are raised upward to the placement surface relative to the middle of the forward end portion in the width direction of the sheet, and the forward end portion and the rear end portion of the tray section give to the sheet placed on the tray section a deflection shape extending along the direction of conveyance of the sheet and curved in the width direction of the sheet.

4. A sheet feeder comprising:

the sheet tray according to claim 1;

a sheet conveyance path leading out of a forward end portion of the tray section; and a conveyance section configured to convey the sheet placed on the tray section to the sheet conveyance path.

5. An image reading device comprising:

a device body;

a sheet feeder disposed in the device body and provided to convey a sheet serving as an original document, the sheet feeder comprising the sheet tray according to claim 1, a sheet conveyance path leading out of a forward end portion of the tray section, and a conveyance section configured to convey the sheet placed on the tray section to the sheet conveyance path; and a reading section disposed facing the sheet conveyance path and configured to read an image of the original document, wherein both ends of the rear end portion of the tray section in the width direction of the sheet are raised upward perpendicularly to the placement surface relative to the middle of the rear end portion in the width direction of the sheet.

6. An image forming apparatus comprising:

an apparatus body;

an image forming section disposed in the apparatus body and configured to form an image on a sheet; and a sheet feeder provided to convey the sheet toward the image forming section, wherein the sheet feeder comprises:

the sheet tray according to claim 1;

a sheet conveyance path leading out of a forward end portion of the tray section; and a conveyance section configured to convey the sheet placed on the tray section to the sheet conveyance path, both ends of the rear end portion of the tray section in the width direction of the sheet are raised upward perpendicularly to the placement surface relative to the middle of the rear end portion in the width direction of the sheet, and the sheet tray is a manual feed tray mounted to the apparatus body.

* * * * *